US010165845B2

(12) United States Patent
Moreau et al.

(10) Patent No.: US 10,165,845 B2
(45) Date of Patent: Jan. 1, 2019

(54) TOOL PACK SYSTEM WITH REMOVABLE TOOL PANELS

(71) Applicant: Ty-Flot, Inc., Manchester, NH (US)

(72) Inventors: Darrell A. Moreau, Manchester, NH (US); Andre W. Moreau, Bedford, NH (US); Reginald J. Moreau, Litchfield, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 15/429,260

(22) Filed: Feb. 10, 2017

(65) Prior Publication Data

US 2017/0340092 A1 Nov. 30, 2017

Related U.S. Application Data

(63) Continuation-in-part of application No. 15/165,080, filed on May 26, 2016.

(51) Int. Cl.
*A45F 3/04* (2006.01)
*B25H 3/00* (2006.01)
(Continued)

(52) U.S. Cl.
CPC ..... *A45F 3/04* (2013.01); *A45C 7/0086* (2013.01); *A45C 13/02* (2013.01); *A45C 13/023* (2013.01);
(Continued)

(58) Field of Classification Search
CPC . A45C 2013/026; A45C 13/02; A45C 13/103; A45C 2013/1015; A45C 7/0086;
(Continued)

(56) References Cited

U.S. PATENT DOCUMENTS 1,742,656 A * 1/1930 Laprade ..... A45C 13/03 190/110
4,385,418 A * 5/1983 Loftis ..... E05D 5/12 16/381
(Continued)

FOREIGN PATENT DOCUMENTS

CA 2635328 A1 * 12/2009 ..... A45C 13/02
CN 202151174 U 2/2012
EP 2233254 A1 * 9/2010 ..... A45C 13/02

OTHER PUBLICATIONS

Mil-Spec Monkey Store, AustriAlpin Cobra Buckle, available at http://milspecmonkey.com (admitted prior art)
Klein Tools, Tradesman Pro Tech Backpack, Cat. No. 55439BPTB, available at http://www.kleitools.cm/catalog/ admitted prior art).
Klein Tools, Tradesman Pro Organizers Brochure (admitted prior art). .
(Continued)

*Primary Examiner* — Nathan J Newhouse
*Assistant Examiner* — Matthew Theis
(74) *Attorney, Agent, or Firm* — Dicke, Billig & Czaja, PLLC

(57) ABSTRACT

A pack system adapted for carrying hand tools includes a tool-carrying container constructed to be worn on a user's person and having a bottom portion, a first shell portion, a second shell portion defining and enclosing a main storage compartment. A releasable closure is connected between the first and second shell portions. At least one tool panel is removably disposed within the main storage compartment and has one or more tool receivers each constructed to retain a hand tool. A panel-retaining structure between the tool panel(s) and the bottom portion of the pack releasably retains the tool panel(s) in the main storage compartment.

16 Claims, 8 Drawing Sheets

(51) Int. Cl.

| | |
|---|---|
| ***A45C 7/00*** | (2006.01) |
| ***A45C 13/02*** | (2006.01) |
| ***A45C 13/10*** | (2006.01) |
| ***B25H 3/02*** | (2006.01) |
| *A45F 3/00* | (2006.01) |

(52) U.S. Cl.
CPC ..... *A45C 13/103* (2013.01); *B25H 3/00* (2013.01); *B25H 3/021* (2013.01); *A45C 2013/026* (2013.01); *A45C 2013/1015* (2013.01); *A45F 2003/001* (2013.01); *A45F 2003/003* (2013.01)

(58) Field of Classification Search
CPC .... A45C 13/023; A45F 3/04; A45F 2003/001; A45F 2003/003; B25H 3/00; B25H 3/021
USPC ..... 224/223, 242, 651, 245, 650, 684, 647
See application file for complete search history.

(56) References Cited

U.S. PATENT DOCUMENTS

| | | | |
|---|---|---|---|
| 5,209,384 | A | 5/1993 | Anderson |
| 2007/0114150 | A1 | 5/2007 | Lin |
| 2008/0029562 | A1 | 2/2008 | Hawkins |

OTHER PUBLICATIONS

Veto Pack, Tech Pac Product Sheet for Veto Pro Pac, available at vetopropac.com.

* cited by examiner

TOOL PACK SYSTEM WITH REMOVABLE TOOL PANELS

BACKGROUND OF THE INVENTION

1. Field of the Invention

The present invention relates generally to portable tool storage and more particularly to a backpack system adapted for storing and transporting hand tools.

2. Description of the Prior Art

Carpenters, electricians, facilities maintenance personnel, and other workers often use a tool belt or pouch to hold tools. One example is a tool pouch attached to a tool belt and is designed to hold a small number of tools. One example is an electrician's pouch configured for wire cutters, screwdrivers, and a small number of other tools. A larger tool apron or tool belt is often used on the job in the construction trades.

Tool containers have also been developed for transporting and storing hand tools. Many such containers have been developed and include tool boxes and tool bags made of rigid and pliable materials. For workers who frequently climb structures, backpacks have been developed to hold a variety of tools while the worker climbs and to present the tools in an easy-to-access arrangement for use when the worker reaches the ultimate work site.

One tool backpack of the prior art is the Tradesman Pro Backpack made by Klein Tools. The Tradesman Pro backpack includes dozens of pockets for tool storage, zipper pouches for small parts, and a hard-molded front pocket for safety glasses and other breakable items. The backpack is worn on the user's back using shoulder straps as is traditionally done with other backpacks. Upon reaching the worksite, the user removes the backpack and unzips the main zipper that extends along the sides and top of the backpack to open the front and rear halves that are connected along a bottom panel. The user may then fold open the front and rear halves of the backpack to display the tools for use. The compartment and storage slots of the Klein Tools backpack are not customizable for specific tools.

For different trades, other manufacturers make tool backpacks that are designed for specific trades or to hold specific tools. Some soft-sided bags, particularly those designed for photographic equipment, feature removable partitions. For example, camera bags have foam partitions that attach along the walls of the bag using a hook-and-loop fastener. The user may change the size and number of sub-compartments within the tool bag by removing or configuring the partitions as needed.

SUMMARY OF THE INVENTION

Although tool backpacks of the prior art may be well built and feature ample tool storage, these backpacks are designed for transporting and using specific tools contained inside the backpack. In other words, these backpacks cannot be reconfigured by the user to carry tools that are not part of the specific design. The prior-art backpacks also have not been made with customizable tool storage or removable tool panels. Further, these prior-art backpacks have not addressed the problem of dropped tools or of dropping the backpack itself.

Workers on oil drilling platforms, wind turbines, and other jobsites may climb ladders, towers, and other structures to reach equipment to be serviced or repaired. When the working at height, the worker risks inadvertently dropping individual tools or the entire backpack. Dropped objects can damage equipment and injure or kill workers below.

Thus, a need exists for an improved pack system for hand tools that can be customized and that features tether attachment points for hand tools. The present invention achieves these and other objectives by providing a pack system with one or more tool panels that are removable from the main storage compartment of a tool-carrying container.

In one embodiment, a pack system adapted for carrying hand tools includes a tool-carrying container constructed to be worn on a user's person. The tool-carrying container has a container base, a first shell portion, a second shell portion, and a releasable closure with a first closure part connected to the first shell portion and a second closure part connected the second shell portion, where the tool-carrying container is operable between an open-container position and a closed-container position and in the closed-container position defines and encloses a main storage compartment. At least one tool panel is removably disposed within the main storage compartment. Each tool panel has a tool panel side portion and a tool panel lower end portion. Each tool panel also has one or more tool receivers constructed to retain a hand tool. The pack system also includes a panel-retaining structure with a first retaining portion secured to tool panel(s) and a second retaining portion secured to an inside surface of the tool-carrying container. The panel-retaining structure is constructed to releasably retain the tool panel(s) in the main storage compartment.

In one embodiment, the first retaining portion is secured to the tool panel lower end portion.

In one embodiment, the first retaining portion includes a plurality of loops extending from the tool panel lower end portion and the second retaining portion includes a retaining base secured to the container base and a retaining bar removably secured to the retaining base and receivable through the plurality of loops. In some embodiments, the second retaining portion structure further includes a second plurality of loops connected to and extending from the retaining base, where the second plurality of loops is constructed to align with the plurality of loops extending from the tool panel lower end portion and to receive the retaining bar therethrough.

In some embodiments, the retaining bar has an end portion defining an opening and the panel-retaining structure includes a releasable connector attached between the retaining base and the opening in the bar end portion.

In some embodiments, the panel-retaining structure is selected as (i) at least one latch plate and a buckle for each latch plate, where each buckle releasably engages one latch plate, (ii) a hook-and-loop fastener with a hook portion or a loop portion connected to the container base and the other of the hook portion or the loop portion connected to the tool panel lower end portion, (iii) a zipper with a first zipper part connected to the container base and a second zipper part connected to the tool panel lower end portion, (iv) a bar connected to the container base and one or more closed-loop connectors connected to the tool panel lower end portion, and (v) a plurality of closed-loop connectors connectable between the container base and the tool panel lower end portion.

In some embodiments, the tool-carrying container includes a tether with tether body extending between a first end portion and a second end portion, and having an auxiliary tether portion extending from the tether body to a closed loop distinct from the second end portion. The first end portion is secured to the tool-carrying container and the second end portion has a connector constructed to engage the closed loop on the auxiliary tether portion. In some embodiments, the first end portion of the tether is secured to an inside of the container base. In some embodiments, the closed loop on the auxiliary tether portion is a closed-loop connector.

In another embodiment, the pack system includes a second panel-retaining structure attached between a side portion of one or more of the tool panels and the first or second portion of the tool-carrying container. In some embodiments, the second panel-retaining structure is attached to a back panel of the first shell portion, where the back panel is constructed to abut a user's back when the backpack is worn on the user's person. For example, the second panel-retaining structure is a connector that connects through an opening along the side portion of the panel and through a loop or opening on the inner surface of the side portion of the backpack.

In another embodiment, the pack system includes an additional panel-retaining structure with a first additional retaining portion secured to the tool panel side portion of one or more tool panel and a second additional retaining portion secured to a side portion of an additional tool panel, where the additional panel-retaining structure is constructed to releasably secure the additional tool panel to another tool panel.

In another embodiment, the tool-carrying container is a backpack, a waist pack, a sling pack, or a shoulder pack. In some embodiments, the first shell portion and/or the second shell portion are made of a pliable material. In other embodiments, the container base is made of a pliable material.

In another embodiment, one or more tool panel defines a panel opening adjacent a perimeter. For example, the panel opening is centered near the top of the panel and can be used for carrying the panel or hanging the panel on a hook.

In another embodiment of the pack system, the tool-carrying container is a backpack having a front, a back, a first side, a second side, a top portion, and a bottom portion. The backpack has a base having a bottom panel on the bottom portion of the backpack, a front base, a rear base, and a sidewall extending along at least part of a perimeter of the bottom panel and extending upward from the bottom panel. A first shell portion is secured to the rear base and defines a back panel configured to abut the user's back. A second shell portion is secured to the front base and is aligned with and opposes the first shell portion. A releasable closure is connected between the first shell portion and the second portion, where the backpack is operable between an open position and a closed position. In the closed position the backpack defines and encloses a main storage compartment. A pair of shoulder straps are attached to and extend between the base and the top portion of the backpack. The system also includes at least one tool panel with one or more tool receivers each constructed to retain a hand tool, the at least one tool panel having a tool panel side portion and a tool panel lower end portion, where each tool panel is sized to be disposed within the main storage compartment.

In one embodiment of the backpack, a rigid floor is spaced vertically above the bottom panel and has a front floor margin connected along the front base and extending upward to a rear floor margin connected to and extending across the back panel. A panel-retaining structure has a first retaining portion on the tool panel lower end portion and a second retaining portion secured to the rigid floor, where the first retaining portion and the second retaining portion releasably interlock to retain the tool panel(s) in the main storage compartment.

In some embodiments of the backpack, the first retaining portion comprises a plurality of loops extending from the tool panel lower end portion and wherein the second retaining portion comprises a retaining base secured to the rigid floor and a retaining bar removably securable to the retaining base and receivable through the plurality of loops.

In another embodiment of the backpack, the second retaining portion structure further comprises a second plurality of loops connected to and extending from the retaining base, where the second plurality of loops is constructed to interlace with the plurality of loops extending from the tool panel lower end portion.

In another embodiment of the backpack, a tether has a first end portion and a second end portion with closed-loop connector, where the first end portion is secured to the base and/or the back panel of the backpack. The tether extends upward along the back panel of the first shell and exits from a tether opening on one of the shoulder straps. In some embodiments, the tether has an auxiliary tether portion extending from the tether body to a closed loop distinct from the closed-loop connector on the second end portion of the tether.

In other embodiments, a connector is constructed to attach between a side portion of the tool panel and an inside surface of the first shell portion. For example, the connector is a carabiner attachable to a loop secured to the inside surface of the first shell portion and to an opening through the tool panel.

DETAILED DESCRIPTION OF THE PREFERRED EMBODIMENT

Figure 1:
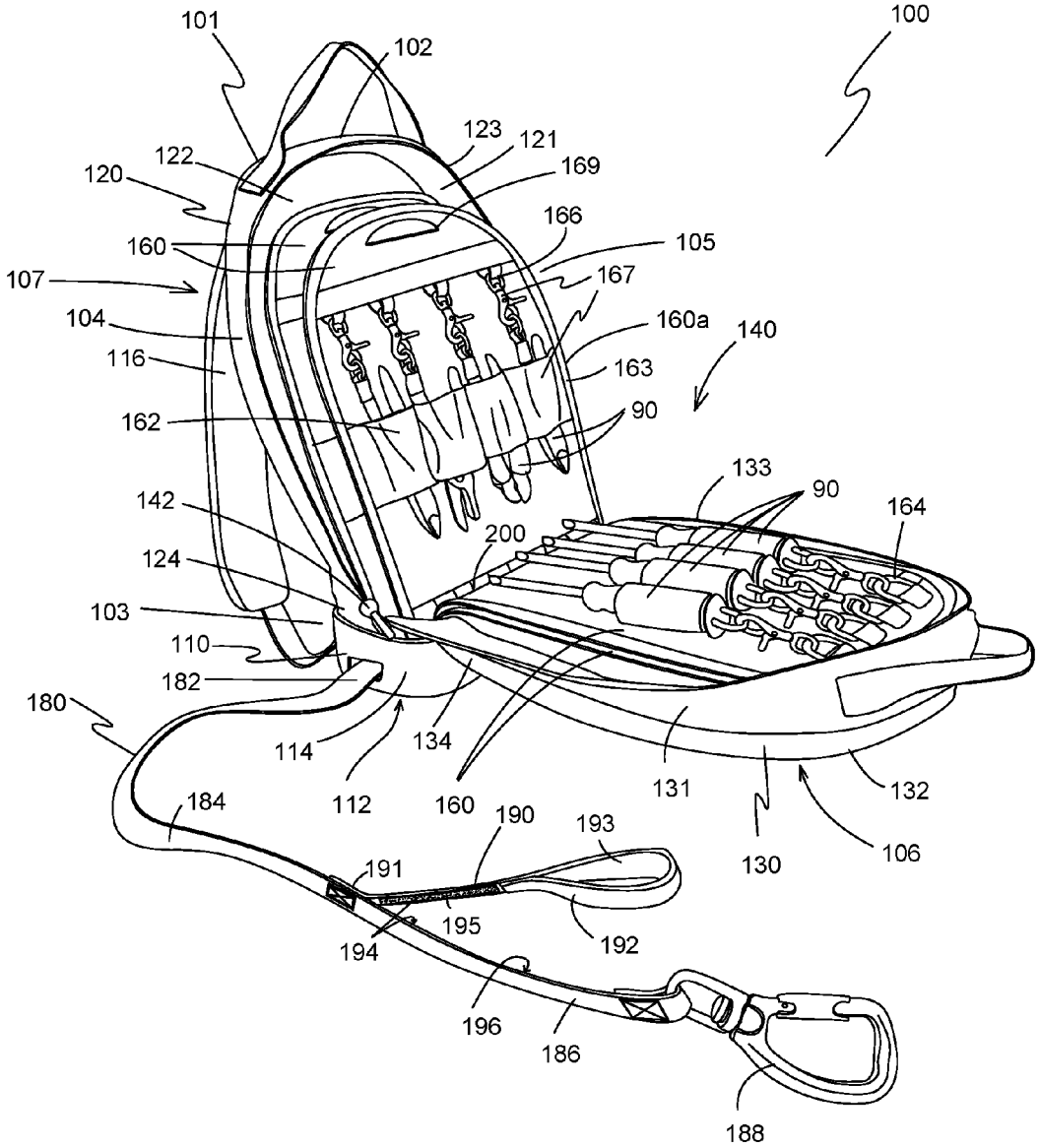
FIG. 1 is a perspective view of one embodiment of a pack system of the present invention shown in an open-container position with a plurality of tool panels attached to an inside of the container base and with an optional tether extending from the container base of the tool-carrying container.

The preferred embodiments of the present invention are illustrated in FIGS. 1-11. FIG. 1 illustrates a front perspective view of one embodiment of a pack system 100 adapted for carrying hand tools. Pack system 100 includes a tool-carrying container 101 with one or more tool panel 160 removably disposed in the tool-carrying container 101. Tool carrying container 101 has a top portion 102, a bottom portion 103, a first side portion 104, a second side portion 105, a front portion 106, and a back portion 107. While illustrated in the Figures as a backpack made of a pliable material, tool-carrying container 101 could also be a sling pack, a waist pack, a shoulder pack, a hip pack, or other container that is constructed to be worn on the user's person and made of pliable materials, rigid materials, or a combination of rigid and pliable materials.

Shown in an open position, tool-carrying container 101 includes a container base 110, a first shell portion 120, and a second shell portion 130. First and second shell portions 120, 130 connect to and extend from container base 110 to define and enclose a main storage compartment 140 when tool-carrying container 101 is in the closed position (shown, e.g. in FIG. 6). In some embodiments, one or more shoulder straps 116 enable pack system 100 to be worn on the user's person with a back panel 122 positioned against the user's back. An optional tether 180 is anchored to tool-carrying container 101 for tethering tool-carrying container 101 to a structure when not being worn by the user. Tether 180 may be anchored at any location to tool-carrying container 101, such as inside of container base 110, or along top or side of first or second shell portion 120,130. Tether 180 may also be used to secure one or more tool panel 160 when the tool panel(s) 160 are removed from tool-carrying container 101, such as tethering tool-carrying container 101 and panel(s) 160 to a structure.

In one embodiment, container base 110 includes a base floor 112 and a perimeter base sidewall 114 extending up from base floor 112. In one embodiment, container base 110 defines a relatively shallow tray with an open top. In one embodiment, container base 110 is made of molded rubber, canvas, vinyl, ballistic nylon, leather, or the like. Since pack system 100 is intended to hold many hand tools 90 with a significant combined weight, container base 110 of tool-carrying container 101 is made of a durable material to resist wear and tear when pack system 100 is dragged, dropped, moved, used, and abused while fully loaded.

In some embodiments, first shell portion 120 has first container panel 122 or back panel 122 with a first sidewall portion 121 extending transversely away from back panel 122 to a first rim 123. When tool-carrying container 101 is a backpack, sling pack, or the like, back panel 122 typically rests against the user's back when tool-carrying container 101 is worn by the user. Similarly, second shell portion 130 has a second panel or front panel 132 with a second sidewall portion 131 extending transversely away from front panel 132 to a second rim 133. Front panel 132 is spaced apart from, is generally aligned with, and faces back panel 122. In one embodiment, first and second shell portions 120, 130 are made of a pliable material, such as ballistic nylon, canvas, leather, or rubberized textiles. Hard plastic, metal, fiberglass, fiber-reinforced polymers, carbon fiber, and other materials with a malleable or predefined form are also acceptable.

Figure 6:
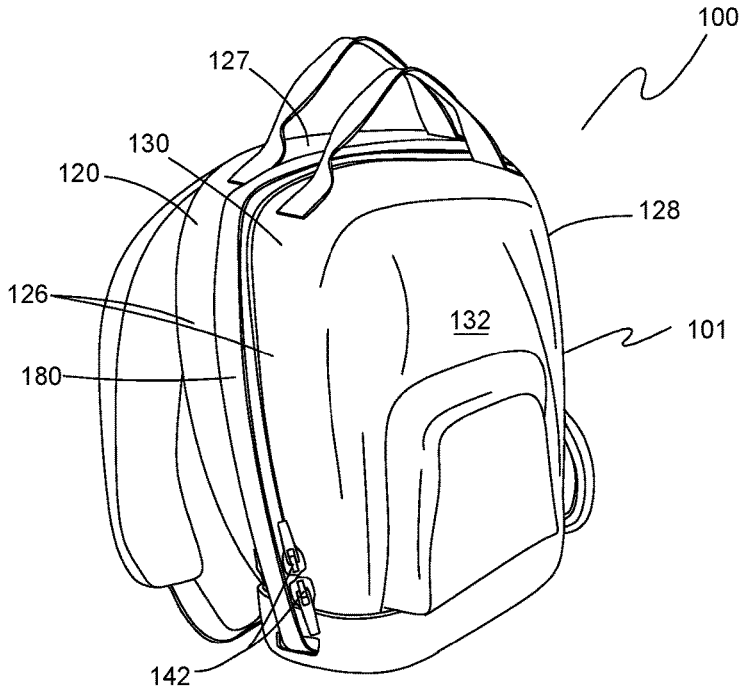
FIG. 6 illustrates a perspective view of one embodiment of a pack system of the present invention shown in a closed-container position.

A releasable closure 142 is installed between first shell portion 120 and second shell portion 130 and operates between an open closure position and a closed closure position (shown, e.g., in FIG. 6). For example, releasable closure 142 extends along first rim 122 and second rim 132 to maintain tool-carrying container 101 in a closed pack position as shown in FIG. 6. In some embodiments, releasable closure 142 is a heavy-duty zipper, a series of flaps with hook-and-loop fasteners, straps with or without fasteners, clasps, or other closure between first and second shell portions 120, 130. Thus, first rim 122 and second rim 132 can be brought together in alignment and fastened with releasable closure 142 so that first shell portion 120 and second shell portion 130 enclose main storage compartment 140. In an open position, first shell portion 120 and second shell portion 130 are able to rotate or fold away from each other for access to main storage compartment 140. In one embodiment, first and second shell portions 120, 130 fold open in a 180° relationship to lay flat on the ground for convenient access to hand tools 90 as shown, for example, in FIG. 7.

A first lower end portion 124 of first shell portion 120 and a second lower end portion 134 of second shell portion 130 are secured to container base 110. In one embodiment, for example, first and second lower end portions 124, 134 are stitched to base along base sidewall 114. In another embodiment, first and second shell portions 120, 130 are continuous with each other and include an end portion (not shown) extending between and connecting first lower end portion 124 and second lower end portion 134. For example, the end portion extends into container base 110 and along base floor 112 where it can be fixed to container base 110 by adhesive, rivets, grommets, or a clamping plate fastened to container base 110. For example, the end portion extends between a clamping plate and base floor 112, where fasteners extend through the clamping plate, floor 112, and end portion. One embodiment of clamping plate is discussed below with reference to FIG. 4.

The one or more removable tool panels 160 of pack system 100 are removably disposed in main storage compartment 140 of tool-carrying container 101. Each removable tool panel 160 is attached to tool-carrying container 101 by a panel-retaining structure 200 connected between tool panel 160 and tool-carrying container 101. Depending on the desired layout of tool panels 160, panel-retaining structure 200 may be attached between a tool panel lower end portion 161 and container base 110 or between a tool panel side portion 163 and a sidewall portion 121/131 of tool-carrying container 101 (or to tool panel side portion 163 of another tool panel 160). Thus, one tool panel 160 may fold or rotate about panel-retaining structure 200 attached to container base 110 and another tool panel 160 may fold or rotate about panel-retaining structure 200 attached to first sidewall portion 121, second sidewall portion 131, back panel 122, second container panel 132, or another tool panel 160. Examples of panel-retaining structure 200 are discussed in more detail below.

Each tool panel 160 is a comparatively thin, flat and generally planar structure that is shaped to be received in main storage compartment 140. Each tool panel 160 is removably attached to tool-carrying container 101 in a way that allows tool panel 160 to rotate or swing about panel-retaining structure 200 for access to one or more hand tools 90 retained by a tool receiver 167 on tool panel 160. Each tool panel 160 is useful as a partition and as a storage panel for storing one or more hand tools 90. For example, a tool receiver 167 is a slot 162, loop 164, anchor point 166, or other feature as needed for holding, tying off, and/or retaining a hand tool 90 or other equipment to tool panel 160.

In one embodiment, tool panels 160 are made of a rigid material and have a shape similar to the profile shape of main storage compartment 140. Tool panels 160 may be made of plastic, metal, fiberglass, wood, or other materials. In one embodiment, tool panels 160 are made of Lexan™ polycarbonate resin sheeting with a thickness of about 0.06 inch. Other materials and thicknesses are also acceptable. In one embodiment, tool panels 160 have with a rigidity sufficient to prevent tool panel 160 from folding on itself or crumpling inside tool-carrying container 101 under the weight of hand tools 90 attached to it. In other embodiments, tool panels 160 have a rigid frame secured to a durable fabric or web extending across the area enclosed by the frame.

In some embodiments, tool panels 160 optionally define a panel opening 169 positioned along a perimeter 160*a* of tool panel 160. Panel opening 169 is useful for carrying tool panel 160 and/or for tethering tool panel 160 to a structure 250. In one embodiment, panel opening 169 is sized for the user's hand to grasp and carry tool panel 160.

In one embodiment, an optional tether 180 is secured to tool-carrying container 101. Tether 180 is made of a pliable material such as nylon webbing, leather, plastic, rope, or paracord. Tether 180 has a first tether end portion 182 secured to tool-carrying container 101 and extending along a tether body portion 184 to a second tether end portion 186. An auxiliary loop member 190 has a first auxiliary end portion 191 and a second auxiliary end portion 192, where second auxiliary end portion 192 defines a closed loop 193. In some embodiments, second tether end portion 186 has a connector 188 constructed to engage closed loop 193 of auxiliary loop member 190. In one embodiment, closed loop 193 is formed by securing second auxiliary end portion 192 to itself. In other embodiments, closed loop 193 is a closed loop of a connector, ring, or other structure secured to second auxiliary end portion 192.

Auxiliary loop member 190 is a separate length of pliable material that extends from tether body portion 184. For example, auxiliary loop member 190 is secured at first auxiliary end portion 191 to tether body portion 184 and extending in a Y with second tether end portion 186. Auxiliary loop member 190 may be aligned with and abut tether strap 180 along at least part of its length. In some embodiments, tether 180 includes a releasable fastener 194 with a first fastener part 195 and a second fastener part 196. For example, auxiliary loop member 190 includes a first fastener part 195 and the corresponding section of tether 180 includes a second fastener part 196 of releasable fastener 194. In one embodiment, releasable fastener 194 is a hook-and-loop fastener where first fastener part 195 is the hook portion secured along tether 180 adjacent second tether end portion 186, and second fastener part 196 is the loop portion secured along auxiliary loop member 190 or vice versa. Other acceptable variants of releasable fastener 194 include magnets, snaps, buttons, or other fasteners. When auxiliary loop member 190 extends along and is brought together in alignment with tether body portion 184, first and second fastener parts 195, 196 are aligned for fastening to each other. Releasably attaching auxiliary loop member 190 to tether body portion 184 retains auxiliary loop member 190 in a stowed position where it is less prone to inadvertently catching on equipment or structures.

Second tether end portion 186 may be looped around a structure 250 (shown in FIG. 7) to attach connector 188 to closed loop 193 of auxiliary loop member 192. Tether 180 may also be used to secure one or more tool panels 160 after removal from tool-carrying container 101. For example, tether 180 is attached through panel opening 169 or passed through panel opening 169 when looping tether to structure 250. When not used for tethering tool-carrying container 101 or tool panel 160 removed from tool-carrying container 101, tether 180 may be stored in main storage compartment 140, in an outside pocket, or in another location on tool-carrying container 101. In some embodiments, tether 180 is stowed by looping over tool-carrying container 101 as shown, for example, in FIG. 6 and optionally securing tether 180 to tool-carrying container 101 with retaining loops or other device as desired. In yet other embodiments, tether 180 is connected to a retractor located in container base 110.

Referring now to FIGS. 2-5, embodiments are shown of panel-retaining structure 200 attached between tool panel 160 and container base 110. In some embodiments, panel-retaining structure 200 includes a first retaining part 202 on tool panel 260 and a second retaining part 210 fixedly attached to tool-carrying container 101 or another tool panel 260. In other embodiments, panel-retaining structure 200 includes additional components. Although embodiments of panel-retaining structure 200 of FIGS. 2-5 are shown attached to container base 110, the various embodiments of panel-retaining structures 200 could similarly be attached between tool panel side portion 163 and container panel 122/132 or sidewall portion 121, 131 of tool-carrying container 101 as illustrated, for example, in FIG. 7.

Figure 2:
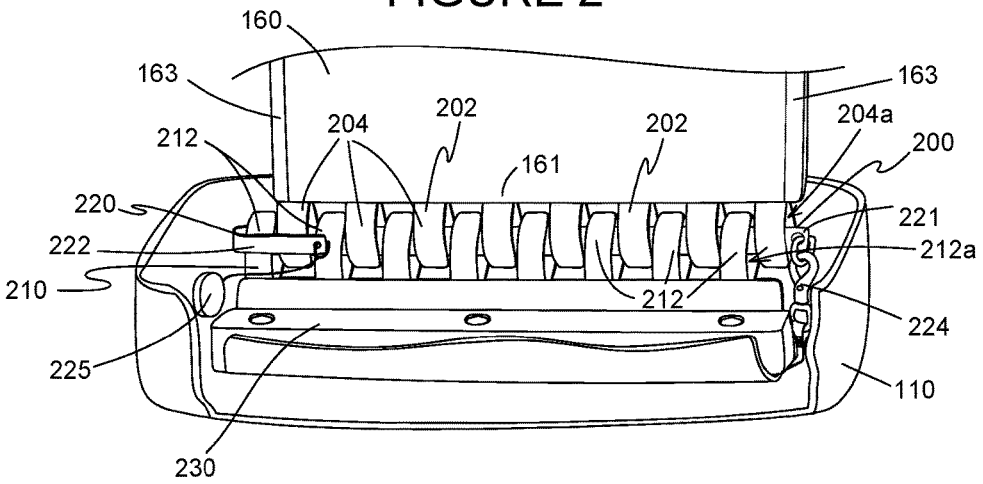
FIG. 2 illustrates an embodiment of the container base of the pack system of the present invention shown partially cut away, a portion of a tool panel, and one embodiment of a retaining structure that includes loops on the tool panel, loops connected to the container base and a retaining pin or retaining bar installed through the loops.

FIG. 2 illustrates a front perspective view of an example of container base 110, a portion of tool panel 160, and one embodiment of panel-retaining structure 200 between tool panel 160 and container base 110. Container base 110 is shown partially cut away to more clearly show panel-retaining structure 200. Panel-retaining structure 200 has a first retaining part 202 formed in or secured to tool panel 160. First retaining part 202 engages a second retaining part 210. In the embodiment shown in FIG. 2, first retaining part 202 of panel-retaining structure 200 includes a plurality of first loops 204 extending from a tool panel lower end portion 161. In one embodiment, first loops 204 are spaced apart and distributed along tool panel lower end portion 161 of tool panel 160.

A second retaining part 210 of panel-retaining structure 200 is attached to container base 110. In one embodiment, second retaining part 210 includes a plurality of second loops 212 secured to and extending from container base 110, where first loops 204 and second loops 212 can be brought together in alignment and interspersed, where first loop openings 204*a* of first loops 204 are aligned with second loop openings 212*a* of second loop 212. As such, a retaining pin 220 can be removably installed through first and second loop openings 204*a*, 212*a*. As needed, retaining pin 220 is secured to container base 110 or otherwise structured to prevent its removal from first and second loops 204, 212. For example, a connector 224 engages first pin end 221 and/or second pin end 222 and prevents removal of retaining pin 220. For example, connector 224 is a spring clip that is tethered to container base 110 with a connector tether 223. Connector tether 223 has a short length sized to prevent removal of retaining pin 220 from first and second loops 204, 212 when connector 224 is attached to retaining pin 220. To prevent loss of retaining pin 220 when it is not in use with tool panel 160, or to prevent inadvertent dropping of retaining pin 220 during removal of tool panel 160, an optional retractable tether 225 secured to tool-carrying container 101 may be used to tether retaining pin 220. Retractable tether 225 may be anchored to an outside or inside of container base 101, first shell 120, second shell 130, or to any other portion of tool-carrying container 101. In one embodiment, tool-carrying container features one or more longitudinal pockets for storing retaining pin(s) 220 when not in use.

In one embodiment, second pin end 222 curves back along retaining pin 220 in a U-shape that extends outside of first and second loops 204, 212. In yet other embodiments, first pin end 221 and/or second pin end 222 has a size that is greater than first loop openings 204*a* and second loop openings 212*a*, where one or both of first pin end 221 and second pin end 222 are removable or alterable to allow retaining pin 220 to pass through first and second loops 204, 212 during installation and removal. For example, first pin end 221 and second pin end 222 have a T-shape or L-shape that must be rotated to align with first loop openings 204*a* and second loop openings 212*a* before retaining pin 220 can be installed or removed. Similar to a hinge, retaining pin 220 prevents separation of first loops 204 from second loops 212 to retain tool panel 160 with container base 110 and permit tool panel 160 to rotate about retaining pin 220 for access to hand tools 90 on either face of tool panel 160.

In one embodiment, all of first loops 204 have the same size and are spaced apart and evenly distributed along tool panel lower end portion 161. Second loops 212 are sized and spaced to fit in the space between adjacent first loops 204. Optionally second loops 212 are positioned at each end of the series of first loops 204 as "bookends" to first loops 204.

In one embodiment, first loops 204 are formed when making tool panel 160 from a sheet of material. For example, a sheet of polycarbonate resin is folded in half and then the folded sheet is shaped to define tool panel 160 to fit in main storage compartment 140. The end of the folded sheet is notched along the fold to define loops along tool panel lower end portion 161. The tool panel 160 is stitched together above the loops and along the edges. Thus, tool panel 160 is defined with first loops 204 extending from tool panel lower end portion 161, where each of first loops 204 has first loop opening 204*a*. Second loops 212 may be similarly formed from a sheet that extends below base plate 230 or is otherwise secured to container base 110, such as by stitching or fasteners in base floor 112. In one embodiment, the sheet extends beneath and is trapped by base plate 230, where the sheet defines a set of second loops 212 on one side of base plate 230 and an additional set (not shown) of second loops 212 on the other side of base plate 230. In some embodiments, container base 110 has a plurality of sets of second loops 212 to accommodate a plurality of tool panels 160. In other embodiments, second loops 212 are wire loops, metal strap formed into loops, closed-loop connectors, flexible straps, webbing, or other material secured to a base plate 230 in container base 110.

Figure 3:
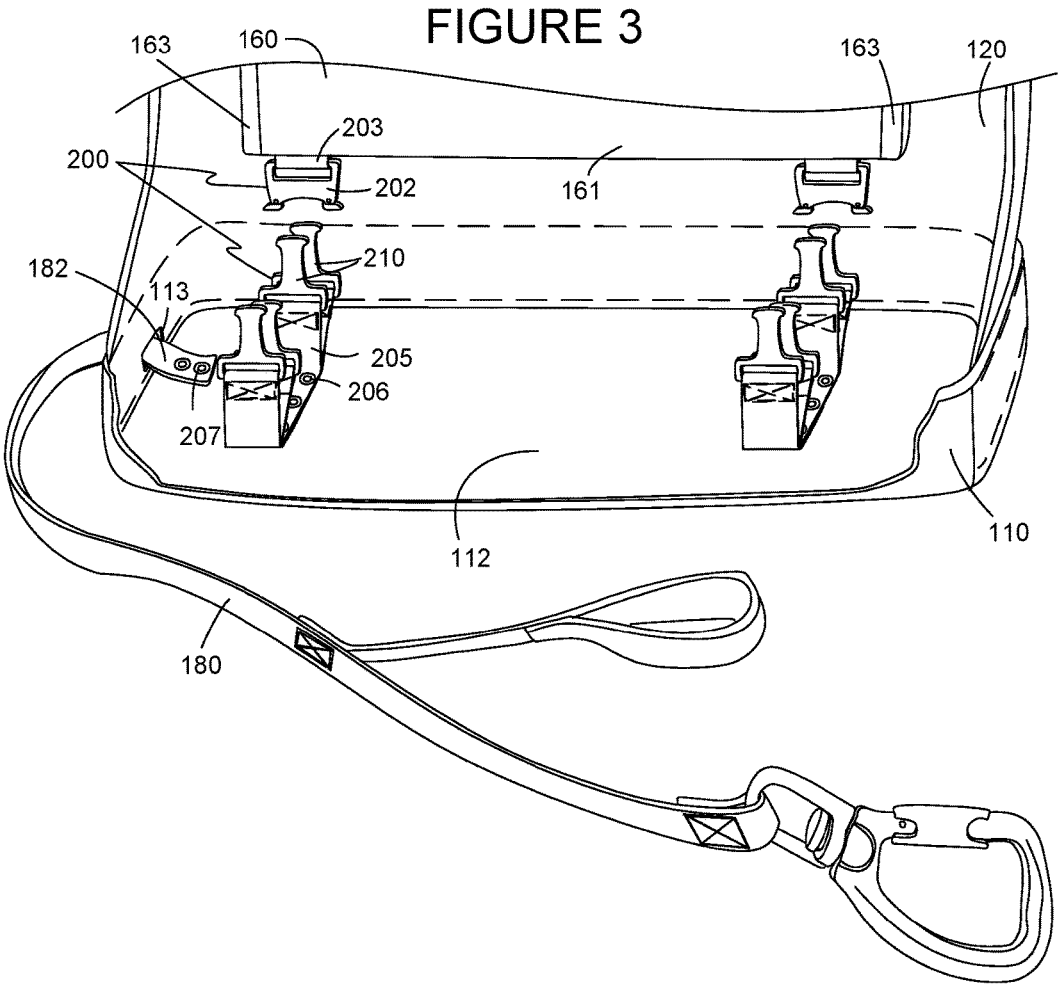
FIG. 3 illustrates an embodiment of the container base of a pack system of the present invention shown partially cut away, a portion of a tool panel, and another embodiment of a retaining structure that includes buckles and latch plates, where buckles are attached to the tool panel and latch plates are attached to the floor of the container base.

Referring now to FIG. 3, a front perspective view illustrates container base 110 with a portion of first shell portion 120, a portion of tool panel 160, and another embodiment of panel-retaining structure 200 comprising load-bearing buckles or other fastener. For example, first retaining part 202 includes a plurality of quick-release buckles and second retaining part 210 is a corresponding plurality of latch plates that are received by the quick-release buckles. First retaining part 202 (e.g., buckles or latch plates) is secured to tool panel lower end portion 161 by webbing 203 or the like. In other embodiments, first retaining part 202 is built into or fixedly attached to tool panel lower end portion 161. Second retaining part 210 (e.g., corresponding latch plates or buckles) are secured to base floor 112 of container base 110. In one embodiment, a length of webbing 205 is attached to second retaining part 210 (e.g., latch plates) and fixedly attached to base floor 112 using fasteners 206, or base plate 230.

FIG. 3 also shows first tether end portion 182 of tether 180 extending through tether opening 113 in container base 110. In one embodiment as shown, first tether end portion 182 is secured to base floor 112 of container base 110 by fasteners 207. Other appropriate attachment methods are acceptable.

Figure 4:
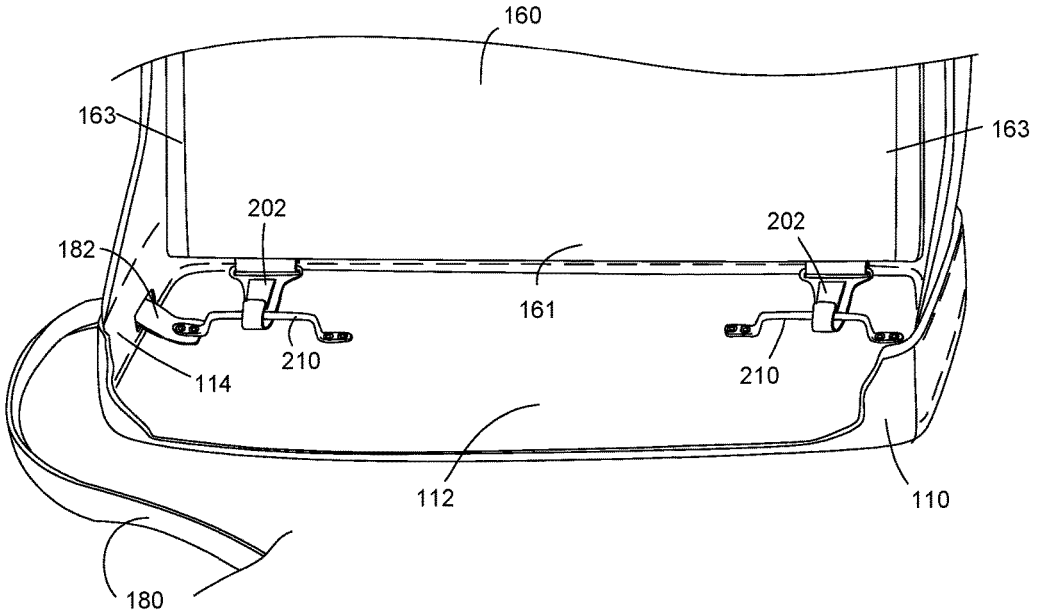
FIG. 4 illustrates an embodiment of the container base of a pack system of the present invention shown partially cut away, a portion of a tool panel, and another embodiment of a retaining structure that includes spring-hook connectors attached to the lower end portion of the tool panel that engage loops connected to the base.

Referring now to FIG. 4, a front perspective view of container base 110 shows another embodiment of panel-retaining structure 200 between container base 110 (shown partially cut away) and tool panel 160. In the embodiment of FIG. 4, first retaining part 202 is a plurality of closed-loop connectors attached to tool panel 160 along tool panel lower end portion 161. For example, first retaining part 202 is a plurality of latch hooks attached to tool panel lower end portion 161. Second retaining part 210 is one or more of an anchor ring or an anchor bar attached to container base 110. In one embodiment, second retaining part 210 is attached to base floor 212; second retaining part 210 could also be attached to base sidewall 114. First retaining part 202 can be any closed-loop connector, such as a carabiner, spring clip, shackle, screw link, spring hook, or other connector. In one embodiment, second retaining part 210 attaches to base floor 112 while also securing first tether end portion 182 of tether 180.

Figure 5:
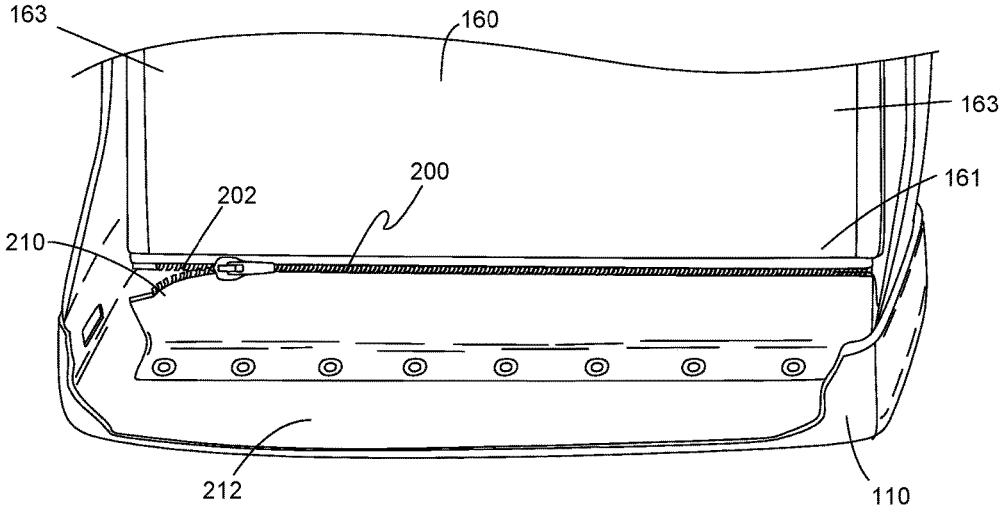
FIG. 5 illustrates an embodiment of the container base of a pack system of the present invention shown partially cut away, a portion of a tool panel, and another embodiment of a retaining structure that includes a zipper.

Referring now to FIG. 5, a front perspective view of container base 110 shows another embodiment of panel-retaining structure 200 between container base 110 (shown partially cut away) and tool panel 160. In the embodiment of FIG. 5, first retaining part 202 is a first zipper part and second retaining part 210 is a second zipper part secured to base floor 212. In yet other embodiments, first retaining part 202 is a strip of hooks or loops of a hook-and-loop fastener and second retaining part 210 is the other mating part of the hook-and-loop fastener.

Referring now to FIG. 6, a perspective view illustrates one embodiment of pack system 100 with tool-carrying container 101 in a closed pack position with first shell portion 120 attached to second shell portion 130 using releasable closure 142 (e.g., a zipper) in the closed closure position. Tether 180 is shown in one example of a stowed position where tether 180 exits tether opening 113 and then loops up along first side portion 126, over top portion 127, and down along second side portion 128. Tool panels 160 with hand tools 90 (shown in FIG. 1) are retained within main storage compartment 140 of tool-carrying container 101.

Figure 7:
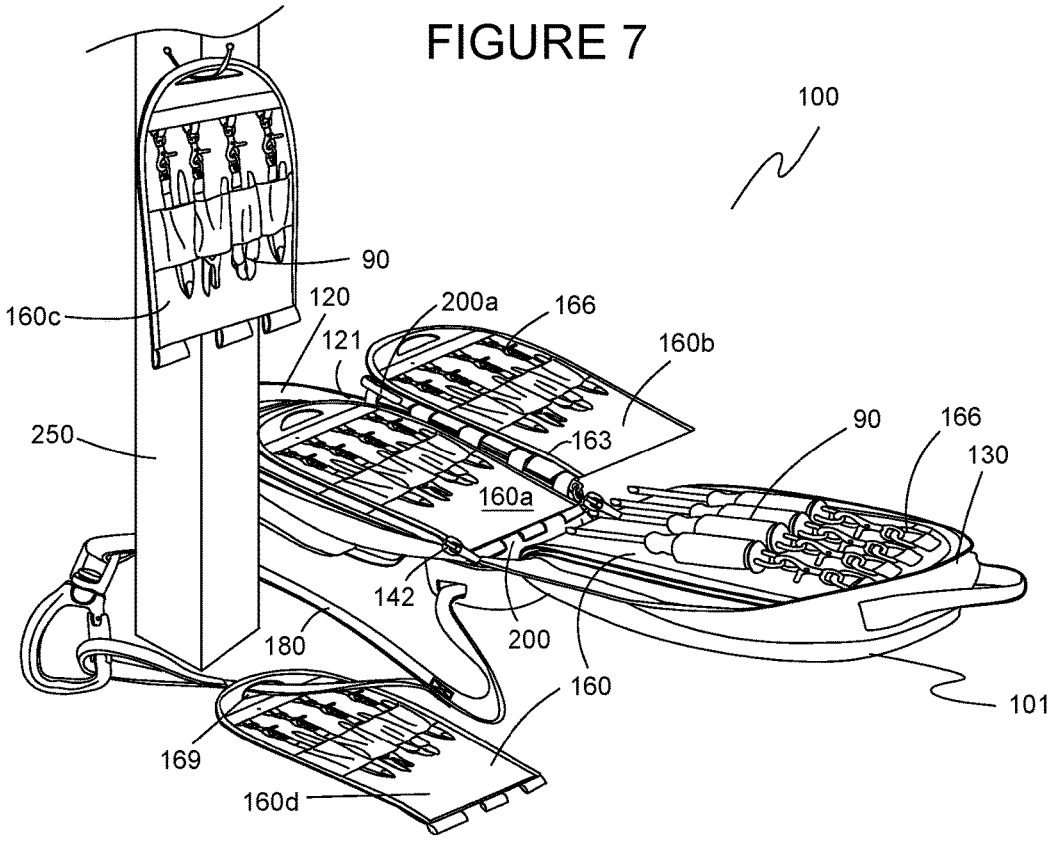
FIG. 7 illustrates a perspective view of one embodiment of a pack system of the present invention shown in use with the tether secured around a post and tool panels in various positions connected to and disconnected from the tool-carrying container.

Referring now to FIG. 7, one embodiment of pack system 100 is shown in use. Releasable closure 142 is in the open closure position to allow first shell portion 120 and second shell portion 130 to open away from each other and lay flat on the ground to present the plurality of hand tools 90 to the user. Tool panels 160 may be folded or rotated about panel-retaining structure 200 for access to the plurality of hand tools 90 on the various tool panels 160. An additional panel-retaining structure 200*a* connects tool panel 160*b* to tool panel 160*a*. Tool panel 160*b* is rotated out of tool-carrying container 101 along additional panel-retaining structure 200*a* attached to tool panel side portion 163 of tool panel 160*b* and to first sidewall portion 121.

Individual tool panels 160 may be removed from tool-carrying container 101 as desired and hung at the worksite for further improved access to hand tools 90. As illustrated, tool panel 160*c* has been removed from tool-carrying container 101 and is hanging on structure 250. Tool panel 160*d* is tethered with tether 180 extending through panel opening 169. Tool-carrying container 101 is tethered to structure 250 and each hand tool 90 is tethered to a tool panel 160 using a connector and anchor point 166 on tool panel 160. As such, embodiments of pack system 100 allow the user to transport hand tools 90 with the ability to reduce or prevent accidental equipment drops of tool-carrying container 101 or individual hand tools 90.

By appropriately equipping tool-carrying container 101 with a sufficient quantity of retractable tethers 225, loops 164, and/or anchor points 166, the user of pack system 100 may achieve 100% tie-off of hand tools 90, tool panels 160, other equipment stored in tool-carrying container 101, and tool-carrying container 101 itself.

Figure 8:
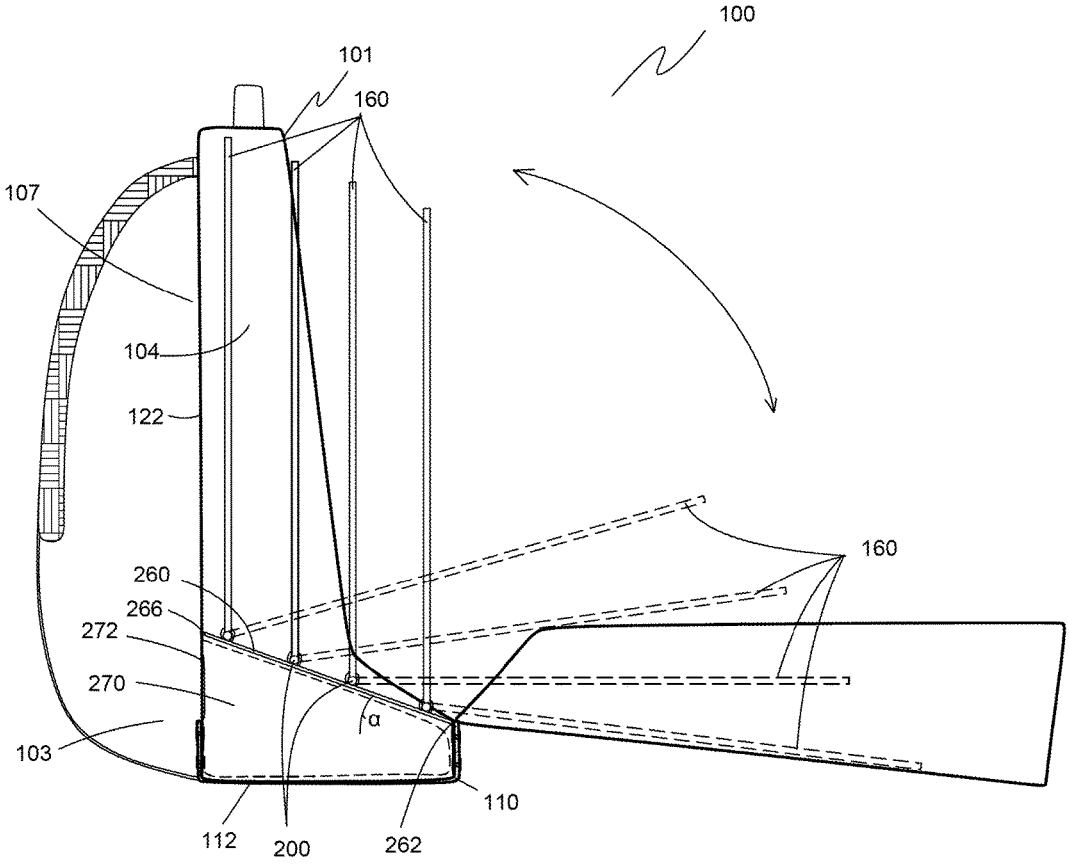
FIG. 8 is a side view of another embodiment of a pack system of the present invention configured as a backpack and showing a rigid floor spaced above the floor of the base, where the retaining structure attaches between each tool panel and the rigid floor.

Referring now to FIG. 8, a side elevational view illustrates another embodiment of pack system 100. In this embodiment, bottom portion 103 includes a rigid floor 260 spaced from base floor 112. Rigid floor 260 has a front floor margin 262 connected along the front portion of base 110 and a rear floor margin 264 connected along the rear panel 122 or base 110 along back portion 107. Rigid floor 260 extends upward from front floor margin 262 to rear floor margin 264 when tool carrying container 101 is in an upright position as illustrated. Rigid floor 260 defines an angle $\alpha$ with base floor 112 from about 10 to about 45 degrees, preferably about 15 to 20 degrees. In some embodiments, rigid floor 260 extends between and connects first side portion 104 and second side portion 105. In some embodiments, base sidewall 114 is taller along back portion 107 of tool carrying container 101 and rear floor margin 264 connects to base sidewall 114 along back portion 107. Panel retaining structure 200 is disposed between panels 160 and rigid floor 200. For example, second retaining part 210 is secured to rigid floor 200.

In some embodiments, rigid floor 260 is made of metal, reinforced plastic, or other rigid material where the material and its thickness are chosen to adequately support tool panels 160 loaded with hand tools 90 (shown in FIG. 1). Rigid floor 260 connects to base 110 by any acceptable means, including stitching and fasteners. In one embodiment, an angle bracket with angle $\alpha$ or a hinge is connected between rigid floor 200 and to base 110 using fasteners, such as rivets. In another embodiment, front floor margin 262 is riveted to base 110 and rear floor margin 264 is stitched to back panel 122.

Since rigid floor 260 is spaced from base floor 112, a base compartment 270 is defined between base 110 and rigid floor 260. In one embodiment, base compartment 270 has a compartment opening 272 through back panel 122 as shown, for example, in FIGS. 9-10. In other embodiments, base compartment 270 has compartment opening(s) 272 through first side portion 104 or second side portion 105.

In addition to defining base compartment 270, an advantage of rigid floor 260 being sloped upward towards rear panel 122 is that tool panel lower end portions 161 of adjacent tool panels 160 have different elevations with respect to each other, thereby positioning each tool panel 160 to fold down to a substantially horizontal position, especially when loaded with hand tools 90 (shown in FIG. 1). In FIG. 8, tool panels 160 are shown in solid lines in an upright position and are shown in broken lines in a folded-down position. Since a tool panel 160 loaded with hand tools 90 may have a thickness of one to two inches, for example, each tool panel lower end portion 161 having a different vertical elevation facilitates folding down each tool panel 160 to a horizontal or near-horizontal position.

Figure 9:
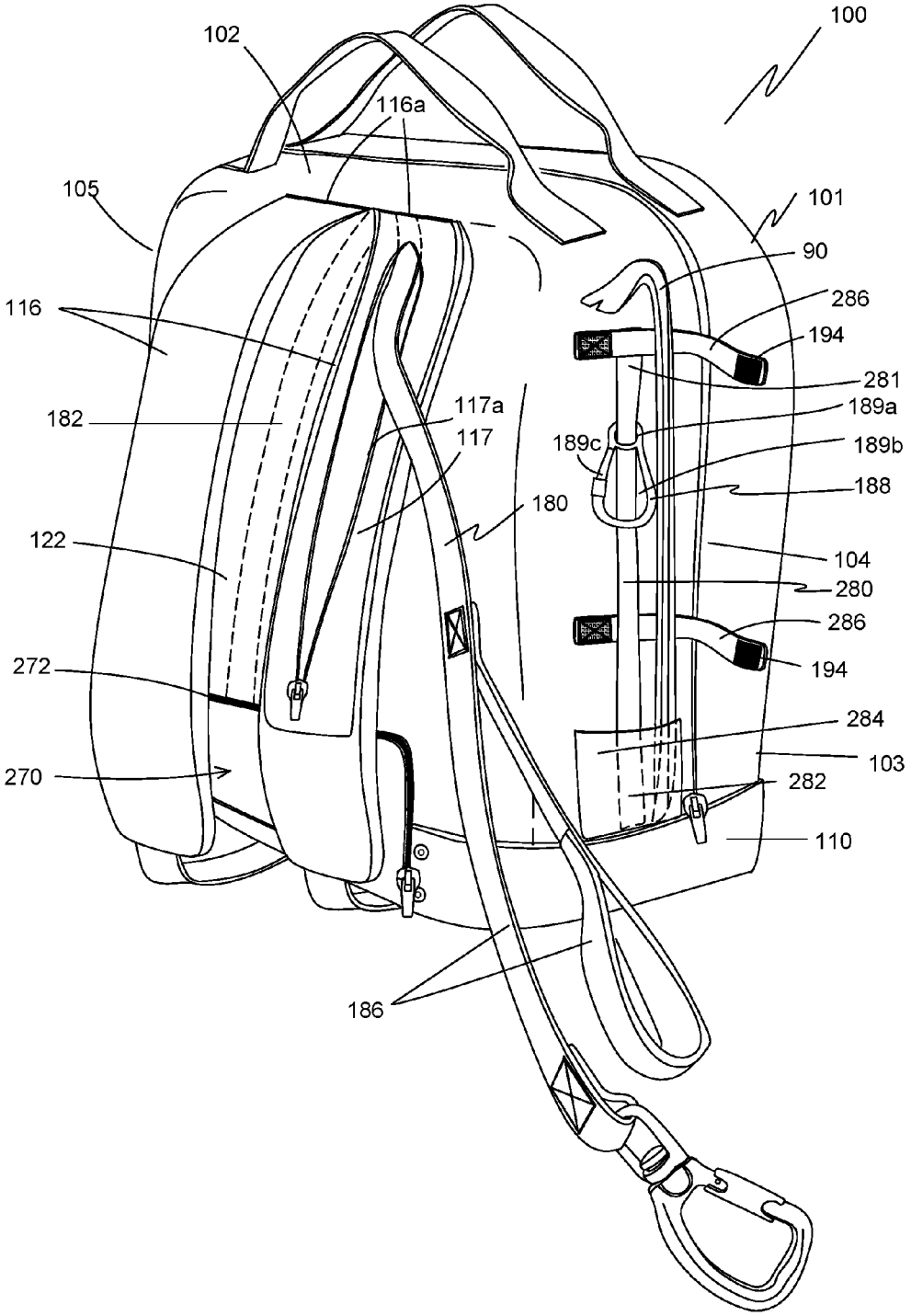
FIG. 9 is a rear perspective view of another embodiment of a pack system of the present invention showing a tether removable from a pocket on the shoulder strap and showing a connector retaining strap on the side portion of the pack with a connector slidably mounted to the strap.

Referring now to FIG. 9, a rear and side perspective view shows another embodiment of a pack system 100 of the present invention. Tool carrying container 101 is configured as a backpack with a pair of shoulder straps 116 connected between base 110 and top portion 102. Base compartment 270 is accessed through compartment opening 272 through back panel 122 and part of base 110 along back portion 107. In FIG. 9, compartment opening 272 is shown in a closed position.

First side portion 104 of the backpack includes a connector 188 movably retained a connector retaining strap 280 oriented vertically and having a first end 281 secured near top portion 102 and second end 282 secured near bottom portion 103 of tool carrying container 101. As illustrated, second end 282 of connector retaining strap 280 is optionally disposed in an open-top pouch 284 on first side portion 104. Pouch 284 is useful to store connector 188 when not used for tethering a hand tool 90. Second side portion 105 could be similarly equipped with connector retaining strap 280.

In one embodiment, connector 188 has a grommet, eye, or other fixed connector opening 189*a* of permanently-closed geometry through which connector retaining strap 280 extends. Fixed connector opening 189 is preferably sized so that connector 188 easily slides along connector retaining strap 280 when connector 188 is positioned perpendicularly thereto, but maintains its position on connector retaining strap 280 due to frictional forces when connector 188 is permitted to hang freely under gravitational forces. Connector 188 also includes a main connector opening 189*b* configured for attachment to hand tool 90. In some embodiments, connector 188 is a carabiner where fixed connector opening 189*a* is a ring and main connector opening 189*b* opens and closes with a gate 189*c*. Connector can be positioned as desired along connector retaining strap 280 for attachment to an attachment point (e.g., an opening or connector) on hand tool 90. For smaller hand tools 90, such as pliers or a wrench, connector 188 may be positioned lower along connector retaining strap 280 and the pliers stored in pouch 284. For larger hand tools 90, such as a crowbar, connector 188 may be positioned higher along connector retaining strap 280 with one end of hand tool 90 placed in pouch 284.

In addition to connector 188 on connector retaining strap 280, tool carrying container 101 in some embodiments also has a plurality of securing straps 286 secured to first side portion 104 (and/or second side portion 105). Securing straps 286 are configured to secure a hand tool 90 aligned along first side portion 104. Each securing strap 286 features a releasable fastener 194 for forming a closed loop around a hand tool 90 or restricting the size of a loop formed by securing strap 286. For example, releasable fastener 194 is a hook-and-loop fastener, a snap, a buckle, a cinch, a slider, or a cleat. Thus, connector 188 may be used to tether the hand tool 90 and securing straps 286 may be used to secure the hand tool 90 to the side portion 104/105 of tool carrying container 101 while the user climbs or moves about a worksite.

FIG. 9 also shows tool carrying container 101 with tether 180 extending out from tether pocket 117 via tether pocket opening 117*a* on one of the shoulder straps 116. For example, tether 180 is fixed to tool carrying container 101 by and extends through a shoulder strap seam 116*a* at top portion 102, typically stitching. First tether end portion 182 is secured along back panel 122, such as to an inside surface or being embedded within back panel 122 itself. In one embodiment, tether pocket 117 is formed along one of shoulder straps 116 with tether pocket opening 117*a* on a front surface of shoulder strap 116. Thus, second end portion 186 may be stowed in tether pocket 117 when not in use.

Figure 10:
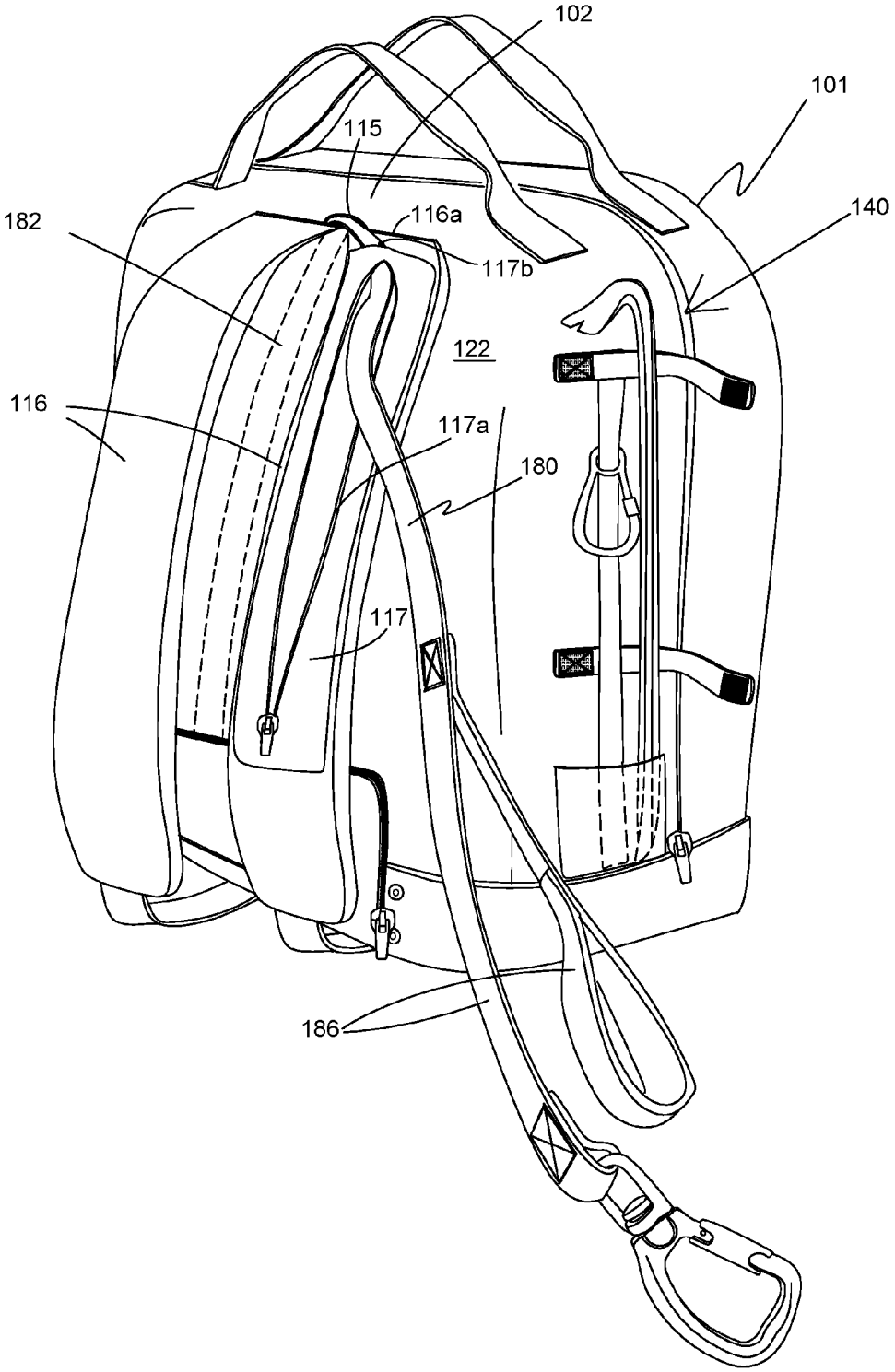
FIG. 10 is a rear perspective view of another embodiment of a pack system of the present invention showing a tether that exits a tether pocket and enters the main compartment of the pack through an opening adjacent the shoulder strap seam.

In another embodiment, shown for example in FIG. 10, tether pocket 117 has an upper pocket opening 117*b*. Tether 180 extends out of tether pocket 117 via upper pocket opening 117*b* and into main storage compartment 140 via a grommet or opening 115 in back panel 122 or top portion 102 of tool carrying container 101. In such embodiments, tether 180 may be partially retracted into main compartment 140 and tether second end portion 186 retained in tether pocket 117. In yet other embodiments, tether pocket 117 communicates with a channel or conduit (not visible) that extends through shoulder strap seam 116*a* and into main storage compartment 140 or into an inside part of back panel 122, where tether 180 is movable through the channel for retracting and deploying tether 180.

Figure 11:
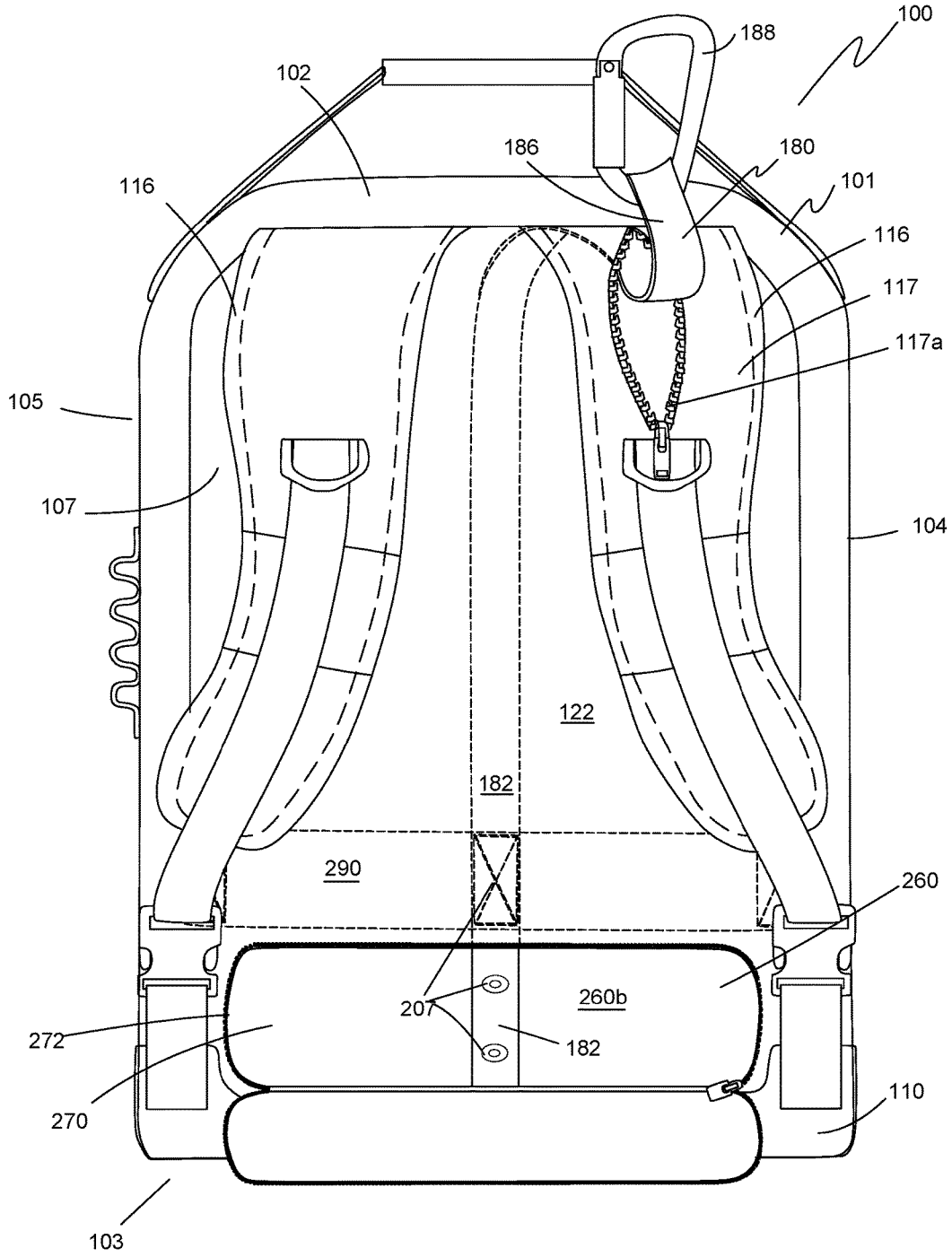
FIG. 11 is a rear elevational view of another pack system of the present invention showing a tether extending along the back panel and through the tether opening, the base compartment in an open position, and a strain plate installed on the back panel.

Referring now to FIG. 11, a rear elevational view shows an embodiment of pack system 100 of the present invention with compartment opening 272 open to base compartment 272. Shoulder straps 116 are secured between base 110 and top portion 102. One or both of the shoulder straps 116 defines tether pocket 117. Tether 180 has first tether end portion 182 extends along and is secured to back panel 122. In one embodiment, first tether end portion 182 also extends along a bottom surface 260*b* of rigid shelf 260 and is secured to rigid shelf 260, such as by rivets or other fastener 207. In other embodiments, first tether end portion 182 is secured to base 110 using fasteners, such as stitching, rivets, or other fastener.

Optionally, a strain plate 290 is sewn into or fastened to back panel 122 using fasteners, such as rivets. Preferably, strain plate 290 is positioned above base 110 and extends horizontally across back panel 122. In some embodiments, strain plate 290 is made of aluminum, polycarbonate, nylon, or other rigid or semi-rigid materials. In one embodiment, for example, first tether end portion 182 is secured to strain plate 290 and to back panel by stitching or other fastener 207, such as rivets.

Second tether end portion 186 with connector 188 may be stored in tether pocket 117 on shoulder strap 116 accessible through tether pocket opening 117*a*. Tether 180 extends from back panel 122 and along part of shoulder strap 116 to exit through tether pocket opening 117*a*. As such, connector 188 is easily accessible to the user without removing the pack system 100 and the user may deploy tether 180 from shoulder strap 116 and secure the pack system 100 by tethering, all prior to removing pack system 100 from the user's body.

Embodiments of pack system 100 of the present invention are useful for users who must climb with tools or who work at height. Pack system 100 enables such workers to tether every hand tool 90 and pack system 100 itself while also having the ability to remove panels 160 from the main storage compartment 140. Accordingly, tool pack system 100 allows the user more efficient and convenient use of tools while preventing inadvertent tool drops.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A backpack system adapted for carrying hand tools comprising:

- a backpack having a front, a back, a first side, a second side, a top portion, and a bottom portion, the backpack comprising:
  - a base having a bottom panel on the bottom portion of the backpack, a front base, a rear base, and a sidewall extending along at least part of a perimeter of the bottom panel and extending upward from the bottom panel;
  - a first shell portion secured to the rear base and defining a back panel configured to abut an user's back;
  - a second shell portion secured to the front base and aligned with and opposing the first shell portion;
  - a releasable closure connected between the first shell portion and the second portion, wherein the backpack is operable between an open position and a closed position and in the closed position defines and encloses a main storage compartment;
- a pair of shoulder straps each attached to and extending between the base and the top portion of the backpack;
- a rigid floor spaced vertically above the bottom panel and having a front floor margin connected along the front base and extending upward to a rear floor margin connected to and extending across the back panel;
- at least one tool panel with one or more tool receivers each constructed to retain a hand tool, the at least one tool panel having a tool panel side portion and a tool panel lower end portion, wherein the at least one tool panel is sized to be disposed within the main storage compartment;
- a panel-retaining structure with a first retaining portion on the tool panel lower end portion and a second retaining portion secured to the rigid floor, wherein the first retaining portion and the second retaining portion releasably interlock to retain the at least one tool panel in the main storage compartment; and
- a tether extending between a first end portion and a second end portion with closed-loop connector, wherein the first end portion is secured to the base and the tether is secured to and extends upward along the back panel of the first shell and exits from a tether opening on one of the pair of shoulder straps.

2. The backpack system of claim 1, wherein the first retaining portion comprises a plurality of loops extending from the tool panel lower end portion and wherein the second retaining portion comprises a retaining base secured to the rigid floor and a retaining bar removably securable to the retaining base and receivable through the plurality of loops.

3. The backpack system of claim 2, wherein the second retaining portion structure further comprises a second plurality of loops connected to and extending from the retaining base, wherein the second plurality of loops is constructed to interlace with the plurality of loops extending from the tool panel lower end portion.

4. The pack system of claim 2, wherein the retaining bar has a first bar end portion defining an opening and wherein the panel-retaining structure further comprises a releasable connector attached between the retaining base and the opening in the first bar end.

5. The backpack system of claim 1, wherein the panel-retaining structure is selected from the group consisting of (i) at least one combination of a latch plate and a corresponding buckle constructed to releasably engage the latch plate, (ii) a hook-and-loop fastener with a hook portion or a loop portion connected to the container base and the other of the hook portion or the loop portion connected to the rigid floor, (iii) a zipper with a first zipper part connected to the rigid floor and a second zipper part connected to the tool panel lower end portion, (iv) a bar connected to the rigid floor and one or more of closed-loop connectors connected to the tool panel lower end portion, and (v) a plurality of closed-loop connectors connectable between the rigid floor and the tool panel lower end portion of each of the at least one tool panel.

6. The backpack system of claim 1, further comprising an auxiliary tether portion extending from the tether body to a closed loop distinct from the closed-loop connector on the second end portion of the tether.

7. The pack system of claim 1 further comprising a connector attachable between a side portion of the at least one tool panel and an inside surface of the first shell portion.

8. The pack system of claim 7, wherein the connector is a carabiner attachable to a loop secured to the inside surface of the first shell portion and to an opening on the at least one tool panel.

9. The pack system of claim 1, wherein an upper end portion of each of the at least one tool panel defines a panel opening.

10. A backpack system adapted for carrying hand tools comprising:

a backpack having a front, a back, a first side, a second side, a top portion, and a bottom portion, the backpack comprising:

a base having a bottom panel on the bottom portion of the backpack, a front base, a rear base, and a sidewall extending along at least part of a perimeter of the bottom panel and extending upward from the bottom panel;

a first shell portion secured to the rear base and defining a back panel configured to abut an user's back;

a second shell portion secured to the front base and aligned with and opposing the first shell portion;

a releasable closure connected between the first shell portion and the second portion, wherein the releasable closure has a first closure part connected to the first shell portion and a second closure part connected the second shell portion, wherein the backpack is operable between an open position and a closed position and in the closed position defines and encloses a main storage compartment;

a pair of shoulder straps each attached to and extending between the base and the top portion of the backpack;

at least one tool panel with one or more tool receivers each constructed to retain a hand tool, the at least one tool panel having a tool panel side portion and a tool panel lower end portion, wherein the at least one tool panel is sized to be disposed within the main storage compartment;

a panel-retaining structure with a first retaining portion on the tool panel lower end portion and a second retaining portion secured in the bottom portion of the backpack, wherein the first retaining portion and the second retaining portion releasably connect to retain the at least one tool panel in the main storage compartment; and a tether extending between a first end portion and a second end portion with closed-loop connector, wherein the first end portion is secured to the base and the tether is secured to and extends upward along the back panel of the first shell and exits from a tether opening on one of the pair of shoulder straps.

11. The backpack system of claim 10 further comprising:

a rigid floor spaced vertically above the bottom panel and having a front floor margin connected along the front base and extending upward to a rear floor margin connected to and extending across the back panel;

wherein the second retaining portion of the panel-retaining structure is secured to the rigid floor.

12. The backpack system of claim 10, further comprising an auxiliary tether portion extending from the tether body to a closed loop distinct from the closed-loop connector on the second end portion of the tether.

13. The backpack system of claim 11, wherein the panel-retaining structure is selected from the group consisting of (i) at least one combination of a latch plate and a corresponding buckle constructed to releasably engage the latch plate, (ii) a hook-and-loop fastener with a hook portion or a loop portion connected to the container base and the other of the hook portion or the loop portion connected to the rigid floor, (iii) a zipper with a first zipper part connected to the rigid floor and a second zipper part connected to the tool panel lower end portion, (iv) a bar connected to the rigid floor and one or more of closed-loop connectors connected to the tool panel lower end portion, and (v) a plurality of closed-loop connectors connectable between the rigid floor and the tool panel lower end portion of each of the at least one tool panel.

14. The backpack system of claim 11, wherein the first retaining portion comprises a plurality of loops extending from the tool panel lower end portion and wherein the second retaining portion comprises a retaining base secured to the rigid floor and a retaining bar removably securable to the retaining base and receivable through the plurality of loops.

15. The backpack system of claim 14, wherein the second retaining portion structure further comprises a second plurality of loops connected to and extending from the rigid floor, wherein the second plurality of loops is constructed to interlace with the plurality of loops extending from the tool panel lower end portion.

16. The pack system of claim 14, wherein the retaining bar has a first bar end portion defining an opening and wherein the panel-retaining structure further comprises a releasable connector attached between the retaining base and the opening in the first bar end.

* * * * *